United States Patent [19]

Brown et al.

[11] Patent Number: 4,648,935

[45] Date of Patent: Mar. 10, 1987

[54] TAPE APPLYING APPARATUS

[75] Inventors: Robert L. Brown, Akron; Sargeant E. Aylies, North Canton, both of Ohio

[73] Assignee: GenCorp Inc., Akron, Ohio

[21] Appl. No.: 685,820

[22] Filed: Dec. 24, 1984

[51] Int. Cl.[4] ..... B32B 35/00

[52] U.S. Cl. ..... 156/577; 156/579; 156/584

[58] Field of Search ..... 156/523, 527, 574, 577, 156/579, 584

[56] References Cited

U.S. PATENT DOCUMENTS

| | | | |
|---|---|---|---|
| 2,291,955 | 8/1942 | Emmey | 156/555 |
| 3,598,684 | 8/1971 | Militana et al. | 156/583.5 |
| 3,617,424 | 11/1971 | Smith | 156/577 |
| 3,709,760 | 1/1973 | Knoner | 156/577 |
| 4,089,730 | 5/1978 | Mahn | 156/584 |
| 4,151,039 | 4/1979 | Lash | 156/584 |

*Primary Examiner*—Michael Wityshyn

[57] ABSTRACT

An apparatus is provided for rolling tape onto a seam between two sheets of flexible material, such as a roofing membrane. The apparatus solves the problem of wave formation in front of the applicator roll by providing a support roll that carries most of the load of the apparatus. There is also provided a means for driving the roll at a peripheral speed faster than the spped at which the apparatus is moving over the material being taped. In addition, means are provided on the apparatus for separating a liner from the tape and for winding up the liner on a storage reel.

5 Claims, 7 Drawing Figures

TAPE APPLYING APPARATUS

FIELD OF INVENTION

This invention relates to a tape applying apparatus. More particularly, it relates to apparatus that has an applicator roll that is pushed along a surface in order to apply the tape. The invention is particularly useful in applying tape to flexible material, such as roofing membranes, for the purpose of splicing together sections of this material. The invention is also useful in the application of tape to which a separating liner has been applied wherein it is desirable to remove the liner as the tape is applied.

BACKGROUND OF THE INVENTION

When applying tape to sections of flexible material, a common problem with roll-type applicators is the formation of a wave in front of the applicator roll. An example of such a roll-type applicator is shown in U.S. Pat. No. 3,962,016, which relates to an applicator for taping the seam between thermoplastic synthetic resin foam sheets. Because of the flexibility of the sheets on which this apparatus rolls, and the weight of the apparatus carried by the applicator roll, the sheets tend to react to the pressure of any rolling by buckling upwardly in front of the roll, creating a wave. Then, when the tape is applied to such a wave in the sheet, there are apt to be air pockets between the tape and the sheet, through which liquid can seep.

SUMMARY OF THE INVENTION

The present invention resides in a tape applying apparatus that solves the problem of the formation of a wave in front of the applicator roll by supporting the apparatus on a support roll behind the applicator roll, with a greater portion of the weight of the apparatus being carried by the support roll than by the applicator roll.

Optionally, the apparatus also includes a mechanism for driving the applicator roll at a speed faster than the support roll. In this manner, the flexible material to which the tape is being applied is pulled under the roll so that no wave is formed.

Also, as another option, the apparatus includes means for separating a liner from the tape immediately after the tape is applied to the flexible surface.

Specifically, the apparatus includes a let-off spindle rotatably mounted on the frame for holding a roll of tape, and an applicator roll rotatably mounted on the housing for receiving tape from the let-off spindle and rolling the tape onto the flexible material, and at least one support roll rotatably mounted on the housing and positioned to roll over the flexible material and support a greater load than the applicator roll.

Additionally, the apparatus can also include means connected between the support roll and the applicator roll for driving the applicator roll at a peripheral speed faster than the peripheral speed of the support roll. This means includes a drive pulley connected to the support roll and an applicator pulley connected to the applicator roll, and an endless drive belt connecting the applicator and drive pulleys.

For applications in which the tape comes with a liner which must be removed, the apparatus also can include a take-up spindle rotatably mounted on the housing and positioned to receive the liner from the applicator roll, a first pulley connected to the let-off roll and a second pulley connected to the take-up spindle, and an endless take-up drive belt connecting the first and second pulleys, the first pullys having a diameter larger than the second pulley.

DESCRIPTION OF THE DRAWINGS

The invention will be better understood having reference to the accompanying drawings, in which.

Figure 4:
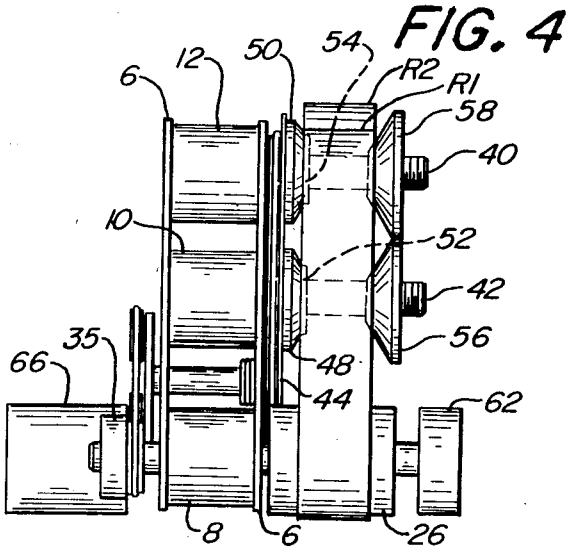
FIG. 4 is a front view of the apparatus of FIGS. 1 and 2.
Figure 3:
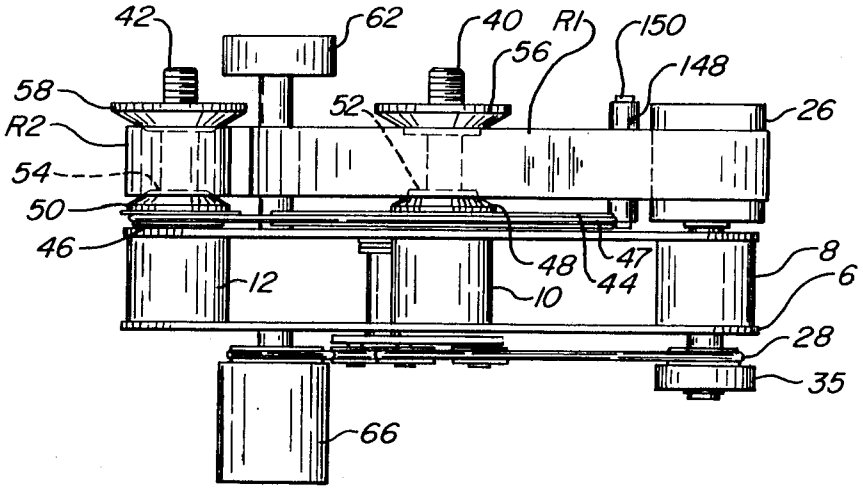
FIG. 3 is a top view of the apparatus of FIGS. 1 and 2.

As illustrated in the main FIGS. 1 through 4, the tape applying apparatus 2 includes a frame 4 made of two panels 6. The panels 6 are spaced apart by a front bearing block 8, a central bearing block 10 and a rear bearing block 12 (FIGS. 3 and 4). A handle anchor 14, shown in dotted lines in FIGS. 1 and 2 also acts as a spacer for the frame panels 6. All of the frame components 6, 8, 10, 12 and 14 are preferably made of a plastic material, such as polyvinyl chloride, so that the frame 4 will be light-weight and corrosion resistant. As illustrated by the cross-section of the block 8 in FIG. 6, the bearing blocks are secured to the panels 6 by metal screws 16. The handle anchor 14, with its attached handle 18, is fixed to the panels 6 by a threaded pin 20 (FIG. 2) and a nut 22 (FIG. 1), the latter preferably being tightened so that the handle 18 cannot be rotated relative to the frame 4.

Figure 6:
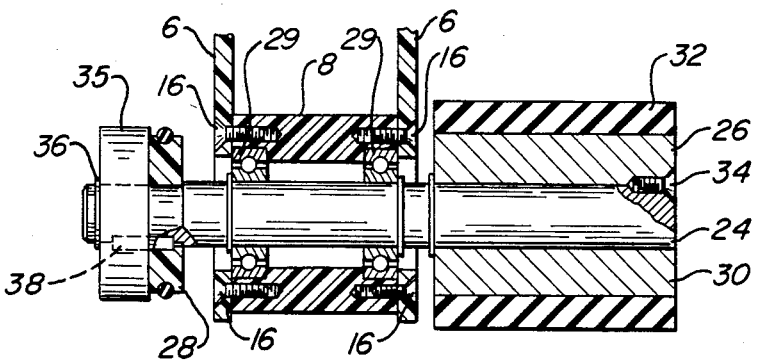
FIG. 6 is a cross-sectional view of a portion of the apparatus of FIGS. 1 through 4, taken along line VI—VI of FIG. 2.

Referring to the cross-section of FIG. 6, the front bearing block 8 is designed to hold a rotatable metal axle 24 on which is mounted an applicator roll 26 and an applicator pulley 28. Preferably the axle 24 is mounted in the bearing block 8 by means of ball bearings, such as the bearings 29 shown in FIG. 6. The applicator roll 26 is made of a metal hub 30, preferably aluminum for its corrosion resistance, and a tread 32 that is preferably made of a rubber of low durometer that is resistant to adhesion, for example a silicone rubber of 27 Shore-A hardness. The resistance to adhesion is important to avoid the tape sticking to the roll 26 instead of the sheet material to which the tape is being laid. A flat head socket cap screw 34 secures the pulley 28 to one end of the axle 24. At the other end, the applicator pulley 28, preferably of a plastic such as polyvinyl chloride, is secured to the axle 24 by a retainer 35 and a clip 36, and is held from rotation relative to the shaft by a key pin 38.

Figure 1:
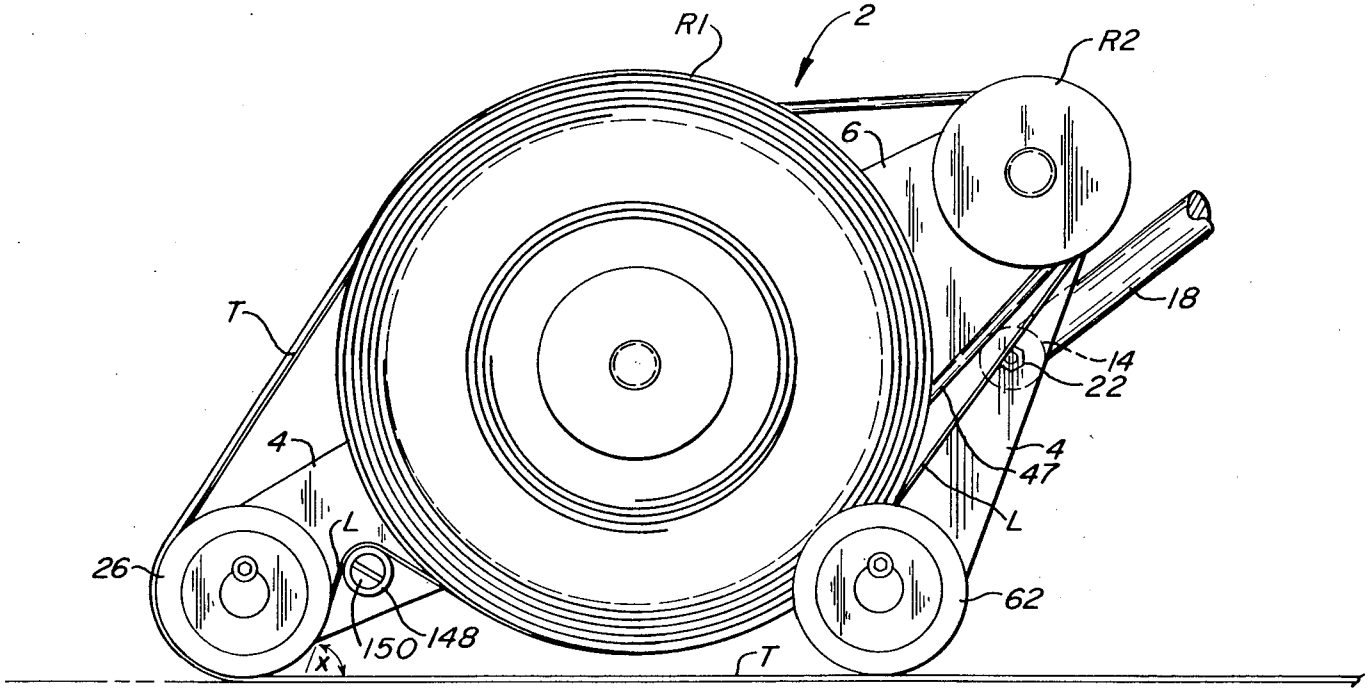
FIG. 1 is a side view of a tape applying apparatus, loaded with a roll of tape to be applied to a surface of flexible sheet material, representing one embodiment of the claimed invention.
Figure 5:
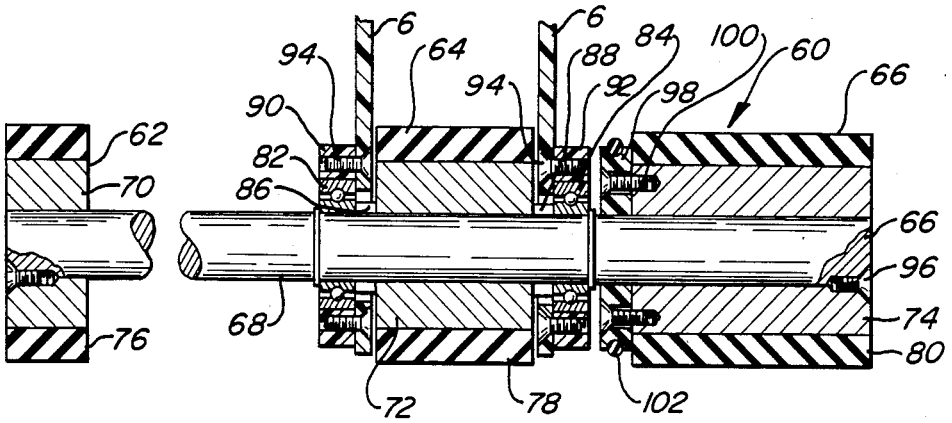
FIG. 5 is a cross-sectional view of a portion of the apparatus of FIGS. 1 through 4, taken along line V—V of FIG. 2.

The central bearing block 10 and rear bearing block 12 hold rotatable let-off and take-up spindles 40 and 42 respectively (FIGS. 3 and 4). Each spindle 40 and 42 is mounted by roller bearings within its respective bearing block in the same manner as the axle 24 is mounted in bearing block 8 (FIG. 5). A large pulley 44 is keyed to the let-off spindle 40 and a small pulley 46, preferably about one-fourth the diameter of the large pulley 44, is keyed to the take-up spindle 42. The pulleys 44 and 46 are connected to each other by an endless rubber O-ring belt 47 (FIG. 1).

The ends of the spindles 40 and 42 that protrude from the frame 4 are threaded, and inner reel retainers 48 and 50 are respectively threaded onto the spindles 40 and 42 and tightened against the respective pulleys 44 and 46. The inner reel retainers 48 and 50 have protruding hub portions 52 and 54 respectively, which are sized to fit in the central openings of let-off and take-up reels R1 and R2. When the reels R1 and R2 have been placed on their respective spindles 40 and 42, tapered outer reel retainers 56 and 58 are threaded onto the spindles to secure the reels. With this construction, let-off and take-up reels of varying widths can be accommodated and securely fastened to the spindles 40 and 42.

In addition to the applicator roll 26 at its front end, the frame 4 also rides on a support roll assembly 60 (FIG. 5) at the rear of the frame. The support roll assembly 60 preferably consists of three support rolls 62, 64 and 66, mounted on a common axle 68, and shown in section in FIG. 5. Like the applicator roll 26, the support rolls 62, 64 and 66 have aluminum hubs 70, 72 and 74 respectively and low durometer silicon rubber treads 76, 78 and 80 respectively. The central hub 72 is held between two ball bearings 82 and 84 by spacers 86 and 88 respectively. Bearing blocks 90 and 92 of polyvinyl chloride or other similar plastic hold the ball bearings 80 and 82 in place and are mounted on the outside surfaces of the frame panels 6 by screws 94. The two outer hubs 70 and 74 are secured to the ends of axle 68 by socket cap screws 96.

Figure 7:
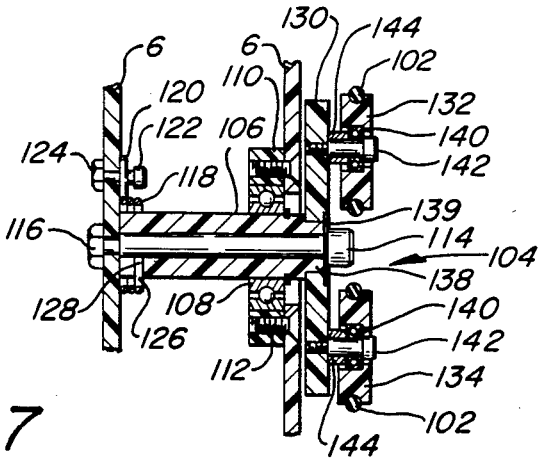
FIG. 7 is a cross-sectional view of a portion of the apparatus of FIGS. 1 through 4, taken along line VII—VII of FIG. 2.

Also, if it is desired to drive the applicator roll 26 faster than the support rolls, a drive pulley 98, preferably of polyvinyl chloride, is secured to the inside end of support roll 66 by screws 100. The drive pulley 98 has a diameter of between 1.1 and 1.4 and preferably about 1.25 times the diameter of the applicator pulley 28, so that when these pulleys are driven by a common belt, the applicator roll 26 will rotate faster than the support rolls 62, 64 and 66. An endless O-ring belt 102 (FIG. 2) connects the drive pulley 98 to the applicator pulley 28. The O-ring belt 102 is held in tension, and away from the surface on which the applicator and support rolls are rolling, by a belt tensioning assembly 104, shown from the side in FIG. 2 and in cross-sectional detail in FIG. 7. The tensioning assembly 104 includes a rotatable tubular plastic shaft 106 supported in a ball bearing 108 mounted in a ring-shaped housing 110. Screws 112 hold the housing 110 to the inside surface of one of the frame panels 6. The shaft 106 is also pivotally supported on pin 114 which is anchored to the left-hand frame panel 6, as viewed in FIG. 7, by a lock-nut 116. The shaft 106 is spring loaded at the anchored end of pin 114 by a coiled spring 118, secured to the frame panel 6 at one end 120 by a screw 122 and nut 124 and having its other end 126 inserted in a hole 128 in the shaft 106.

Figure 2:
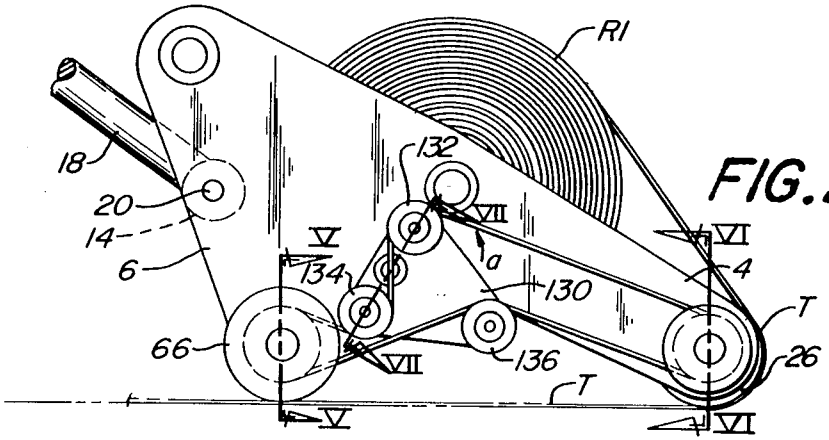
FIG. 2 is a side view of the other side of the apparatus shown in FIG. 1.

Mounted on the other end of shaft 106 is an arm 130, which is preferably in the shape of a triangle and carries three tensioning rollers 132, 134 and 136 (FIG. 2). The shaft 106 has a square cross-sectioned portion 138 that fits within a square hole in arm 130, and a washer 139 (FIG. 7) set in a recess in the arm 130 holds the arm 130 on the shaft 106. As shown in the cross-section of two of the rollers in FIG. 7, each roller 132, 134 and 136 is made of plastic and is rotatably mounted by means of a steel bearing 140 on a steel pin 142 that is threaded into the plastic arm 130. A plastic spacer 144 maintains each roller against the head of the pin 142.

The spring 118 tends to turn the shaft 106 and the arm 130 in a counterclockwise direction as viewed in FIG. 2. Thus, the spring force on roller 132 is upward and to the left, as indicated by arrow a in FIG. 2, the force on roller 134 is downward and to the right as indicated by arrow b, and the force on roller 136 is upward and slightly to the right, as indicated by arrow c. An endless rubber O-ring belt 102 connects the drive pulley 98 to the applicator pulley 28 and is threaded through the rollers 132, 134 and 136 as shown in FIG. 2. The spring loading of the rollers 132, 134 and 136 maintains the belt 102 in tension, and in particular, the roller 136 raises the lower traverse of the belt 102 so that it cannot contact the surface on which the apparatus 2 is being rolled.

For the purpose of separating the liner from the tape as the tape is being applied, the apparatus 2 is preferably equipped with an intermediate aluminum roller 148, shown in FIGS. 1 and 3. The roller 148 is rotatably mounted on a pin 150 that is screwed to one of the frame panels 6. The positioning of roller 148 is important because its purpose is to draw the liner away from the tape at as high an angle as possible, so that there is no tendency for the liner to remain stuck to the tape after the tape has left the applicator roll 26. Thus, the roller 148 should be positioned so that the angle x (FIG. 1) of the liner coming off the applicator roll is at least 60° and preferably closer to 90° to the surface on which the apparatus 2 is being rolled.

The weight distribution of the various components of the apparatus 2, and the locations of the let-off and take-up spindles 40 and 42 with respect to the locations of the applicator roll 26 and support rolls 62, 64 and 66 is very important. The center of gravity of the apparatus 2, including whatever tape or liner is being carried on the let-off and take-up spindles, must always be closer to the support rolls 62, 64 and 66 than it is to the applicator roll 26. This means that the center of gravity of the apparatus 2 without any tape or liner should be closer to the support rolls 62, 64 and 66 than the applicator roll 26. Preferably, both spindles 40 and 42 carrying the tape and liner should be located closer to the support rolls 62, 64 and 66 than the applicator roll 26.

The weight carried by the applicator roll 26 should be enough to allow the applicator roll 26 to remain in contact with the surface to which the tape is being applied. The remainder of the load should be carried by the support rolls 62, 64 and 66. Thus, if any buckling of the sheet material receiving the tape occurs, it will be immediately in front of the support rolls, where the tape has already been applied. Also, later when applicator roll is drivn at a peripheral speed faster than the support rolls, the support rolls will be under the greatest load for maintaining a non-slipping rolling contact with the surface being taped.

To use the apparatus 2, a worker places a reel R1 of rubber tape T covered with a liner L on the let-off spindle 40 and secures the reel R1 with retainer 56. He also places an empty take-up reel R2 on the spindle 42 and secures it with retainer 58. He then winds the lead end of the tape T covered with the liner L around the applicator roll 26 as shown in FIG. 1. At that point, the worker separates the liner L from the tape T and winds the liner L over the roller 148 and back around the bottom side of the tape on the reel R1. From there, he pulls the liner L up to the empty take-up reel R2 on the spindle 42, and secures the end of the liner L to the take-up reel R2.

The worker is then ready to roll the apparatus 2 along a seam of roofing material or other surface to be taped. As the apparatus 2 is pushed along the taped surface, most of the weight of the apparatus 2 will be on the support rolls 62, 64 and 66 because of the above described weight distribution of the components of the apparatus 2. Thus, the support rollers 62, 64 and 66 will have a firm engagement with the surface on which they are rolling, and, through their connection with the applicator roll 26 by means of pulleys 28 and 98 and belt 146, the support rolls will drive the applicator roll with its smaller pulley at a peripheral speed faster than the speed at which the apparatus 2 is being pushed. This will cause the applicator roll 26 to pull the material on which it is rolling toward itself and will prevent the formation of any wave that might tend to build-up in front of the applicator roll.

Also, because of the size difference between the pulleys 44 and 46, the take-up reel R2 will rotate considerably faster than the let-off reel R1, maintaining the liner L in tension as it is pulled from the tape T at the rear of the applicator roll 26. This will insure that the liner L does not remain stuck to the tape T after the latter has been applied to the surface being taped, and will insure that the liner L does not drop downward on its way from the applicator roll 26 to the take-up reel R2. Because of the tendency of the take-up pulley 42 to rotate faster than it needs to in order to wind up the liner L, the O-ring belt will slip on the pulley 42, there being a large amount of such slippage when the take-up reel is unloaded, and less and less slippage as the diameter of the liner around on the reel is increased.

While the foregoing represents one embodiment of the present invention, other embodiments, modifications and additions will be apparent to those skilled in the art, while remaining within the scope of the following claims.

What is claimed is:

1. Apparatus for applying tape to a sheet of flexible material including a frame, a let-off spindle rotatably mounted on the frame for holding a roll of tape, and an applicator roll mounted on an applicator axle that is rotatably mounted on the housing for receiving tape from the let-off spindle and rolling the tape onto the flexible material, wherein the improvement comprises:

(a) a support roll mounted on a support axle that is rotatably mounted on the housing and positioned to roll over the flexible material, said support roll being positioned closer to the center of gravity of the apparatus than said applicator roll; and (b) means connected between the support roll and the applicator roll for driving the applicator roll at a peripheral speed faster than the peripheral speed of the support roll and including (1) a drive pulley fixed to the support roll and an applicator pulley fixed to the applicator roll, the drive pulley having a diameter larger than the applicator pulley, (2) an endless applicator drive belt connecting the applicator and drive pulleys, and (3) means for tensioning the applicator drive belt between the pulleys.

2. The apparatus as set forth in claim 1 wherein the drive pulley has a diameter that is between 1.1 and 1.4 times the diameter of the applicator pulley.

3. The apparatus as set forth in claim 1 designed for applying tape which carries a liner and for separating the liner from the tape as the tape is applied, wherein the improvement comprises:

(c) a take-up spindle rotatably mounted on the housing and positioned on the side of said let-off spindle opposite from said applicator roll to receive the liner from the applicator roll; and (d) a first pulley connected to the let-off roll and a second pulley connected to the take-up roll, and an endless take-up drive belt connecting the first and second pulleys, the first pulley having a diameter larger than the second pulley.

4. The apparatus as set forth in claim 3 wherein the first pulley has a diameter that is approximately 4 times the diameter of the second pulley.

5. The apparatus as set forth in claim 3 wherein the improvement also comprises:

(e) an intermediate roller for guiding the liner between the applicator roll and the take-up spindle, the intermediate roller being rotatably mounted on the frame between the take-up spindle and the applicator roll and positioned to lift the liner off the applicator roll at an angle of greater than 60° to a straight line extending tangent to both the bottom of the applicator roll and the bottom of the support roll.

* * * * *